United States Patent [19]

Roath et al.

[11] Patent Number: 4,824,394

[45] Date of Patent: Apr. 25, 1989

[54] IDC CONNECTORS WITH ROTATED CONDUCTOR PAIRS AND STRAIN RELIEF BASE MOLDED ONTO CABLE

[75] Inventors: Alan L. Roath, Madison, Ohio; John N. Tengler, Chico, Calif.

[73] Assignee: Ohio Associated Enterprises, Inc., Painesville, Ohio

[21] Appl. No.: 12,190

[22] Filed: Feb. 9, 1987

Related U.S. Application Data

[63] Continuation-in-part of Ser. No. 850,254, Apr. 10, 1986, abandoned.

[51] Int. Cl.[4] ..... H01R 4/24

[52] U.S. Cl. ..... 439/395; 439/736; 439/494; 29/858

[58] Field of Search ..... 439/736, 738, 739, 391, 439/392, 395–407, 409, 417, 422, 426, 492–499; 29/857, 858, 861, 863, 865, 866, 867, 883, 854, 855, 856

[56] References Cited

U.S. PATENT DOCUMENTS

| | | | |
|---|---|---|---|
| 2,720,635 | 10/1955 | Odegaard | 439/418 |
| 2,888,659 | 5/1959 | Gilbert | 339/99 |
| 3,444,506 | 5/1969 | Wedekind | 339/99 |
| 3,617,982 | 11/1971 | Hardesty | 339/91 |
| 3,820,055 | 6/1974 | Huffnagle et al. | 339/17 F |
| 3,994,554 | 11/1976 | Navarro | 339/99 R |
| 4,025,141 | 5/1977 | Thelissen | 339/97 |
| 4,030,799 | 6/1977 | Venaleck | 339/99 R |
| 4,094,564 | 6/1978 | Cacolici | 439/604 |
| 4,288,139 | 9/1981 | Cobaugh et al. | 339/74 R |
| 4,350,409 | 9/1982 | Kato et al. | 339/186 M |
| 4,365,857 | 12/1982 | Watanabe et al. | 339/17 C |
| 4,403,820 | 9/1983 | Rich | 339/97 R |
| 4,492,023 | 1/1985 | Schneider et al. | 29/861 |
| 4,528,749 | 7/1985 | Heft | 29/858 |
| 4,537,455 | 8/1985 | Vertenten et al. | 339/99 |
| 4,596,428 | 6/1986 | Tengler | 439/606 |
| 4,671,596 | 6/1987 | Soma | 439/404 |

FOREIGN PATENT DOCUMENTS 1327302 1/1972 United Kingdom .

*Primary Examiner*—David Pirlot

*Attorney, Agent, or Firm*—Renner, Otto, Boisselle & Sklar

[57] ABSTRACT

A cable termination assembly (200) includes a flat ribbon multiconductor cable (204), able to be slit to separate the conductors into respective pairs of adjacent conductor that are able to be rotated or twisted, a strain relief body (210) directly molded to the cable (204) to form an integral structure therewith, plural electrical contacts (212) that are placed in IDC relation to form IDC junctions with respective conductors (208) of the cable, and a separate cover (214) that can be slid over at least part of the contacts and strain relief body for fastening with respect thereto. The conductor pairs are twisted during the molding step, and as a result of the twist the outboard conductors are brought adequately inboard of the ends of the assembly to facilitate the desired IDC connections while maintaining side and end stackability. A method and apparatus for making the cable termination assembly.

46 Claims, 9 Drawing Sheets

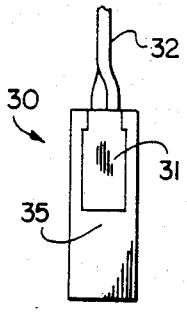
FIG. 2
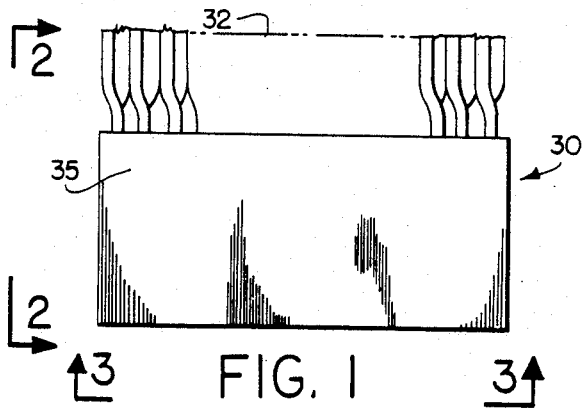
FIG. 1
FIG. 3
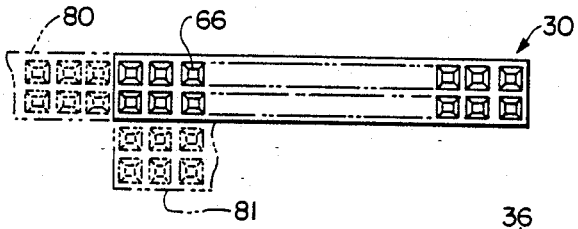
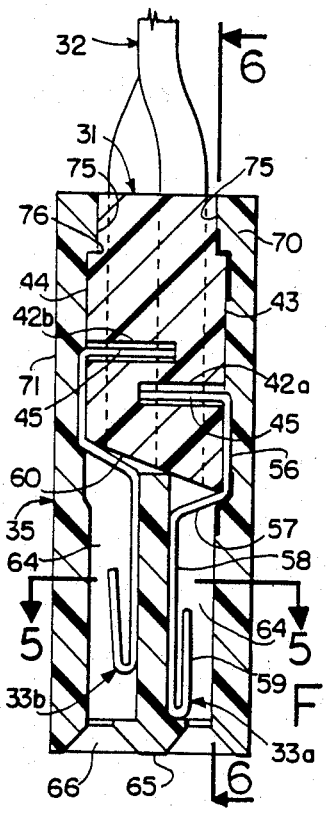
FIG. 4
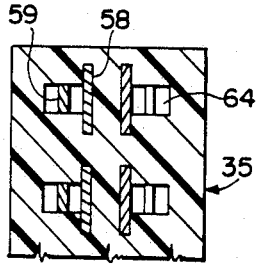
FIG. 5
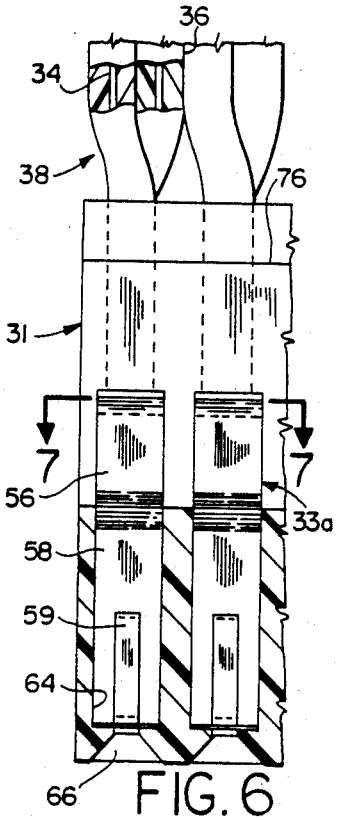
FIG. 6

IDC CONNECTORS WITH ROTATED CONDUCTOR PAIRS AND STRAIN RELIEF BASE MOLDED ONTO CABLE

This application is a continuation-in-part of commonly owned pending U.S. patent application Ser. No. 850,254, filed Apr. 10, 1986, now abandoned, the entire disclosure of which is incorporated by reference.

DISCLOSURE

The invention herein described relates generally to multi-conductor electrical cable/connector assemblies and, more particularly, to IDC cable/connector assemblies including a strain relief base molded onto flat ribbon multi-conductor cable. The invention also relates to such assemblies with rotated conductor pairs and method and apparatus for making same, especially with the rotated zone retained in the strain relief body.

BACKGROUND

The use of flat ribbon multi-conductor electrical cables in the electronics industry is, of course, widespread. Such cables include a plurality of electrical conductors contained in and electrically isolated from each other by electrical insulation. The insulation may be of various electrically non-conductive materials, usually plastic or plastic-like materials such as polyvinylchloride.

Various techniques have been employed to terminate such flat ribbon cables, for example, by connection of the conductors thereof to respective electrical contacts that may be grouped in a male or female socket-like electrical connector housing to facilitate electrical connection of such conductors to other circuits such as by a mating electrical connector or connection device. One such technique, commonly referred to as an insulation displacement connection (IDC) technique, provides for simultaneous connection of plural contacts to respective conductors of the cable. Typically, IDC ribbon cable connectors include multiple housing parts between which the cable is clamped, and usually before or during clamping the plural contacts of the connector puncture the electrical insulation of the cable to connect with respective conductors. The housing parts are mechanically secured in clamping engagement with the cable, and strain relief is usually provided by the clamping strength and/or by the terminal parts of the contacts pierced through the cable insulation.

Another technique for terminating flat ribbon multi-conductor cables is disclosed in U.S. Pat. No. 4,030,799. This technique provides for direct penetration of electrical contacts through the cable insulation to connect with respective conductors therein followed by molding a body of dielectric material directly about at least part of the contacts and cable to secure the same as an integral structure.

Many if not most flat ribbon cable/connector assemblies are intended to couple with a mating connector or connection device of opposite gender such as pin header for a female cable connector or a socket for a male cable connector. In some instances, it may be desirable to couple cables to a pin field or matrix provided on a circuit board or other substrate. The pin field, for example, may be a grid-like arrangement of pins to which multiple cables are to be coupled by respective cable connectors. It is desirable to have cable connectors that are end-to-end and/or side-to-side stackable to minimize space required for same when connected to a pin field or the like, especially wherein the center-to-center spacing of the pins and of the contacts intended to be connected thereto is uniform throughout the rows and columns of the pin field.

Insert molding is a technique that may be used to make the cable termination assembly disclosed in U.S. Pat. No. 4,030,799. Insert molding usually has special cavity configurations to hold contacts in place as strain relief material is molded about and engagement with part of the contacts and shut off requirements to prevent strain relief molding material from engaging other parts of the contacts.

Overflow molding is a technique in which molding material may be molded about another object without the more severe requirements of insert molding. An example of overflow molding is described below and in the parent patent application in which a strain relief molding material is molded directly to a part of a cable without there being any pre-placed and connected contacts about and to which molding material is to be directly molded. Frequently overflow molding is less exacting, difficult, time consuming and expensive than insert molding.

As is described in further detail below, the present invention provides improvements in electrical connectors, especially of the IDC type, and in overflow molding apparatus and techniques for making such connectors.

The invention will be described below with respect to an electrical cable/connector assembly sometimes referred to as a cable termination assembly. In the art the term cable termination or simply termination often refers to a connector placed on an electrical cable. The term cable termination assembly generally often refers to the combination of such a connector and the cable or at least part of the cable. It will be appreciated that a cable termination may be placed at various locations along the length of an electrical cable, including the ends thereof.

SUMMARY OF THE INVENTION

An electrical cable/connector assembly according to the present invention is characterized by a strain relief base of electrically non-conductive material molded directly onto a flat ribbon multi-conductor cable or the like to provide strain relief, a guide for IDC contacts pressed into mechanical and electrical engagement with respective conductors of the cable to form electrical junctions therebetween, and a mount for attachment thereto of other connector components such as a cover for the contacts. Briefly, the molded base includes plural recesses through which terminal portions of contacts are guided to connect with respective conductors in the cable to form a base/contact/cable sub-assembly over which a cover is installed securely to hold the contacts in proper position.

More particularly, there is provided an electrical cable/connector assembly comprising a cable including a plurality of generally parallel conductors and insulation therefor; a strain relief base molded onto the cable, the base including a plurality of externally opening recesses aligned with respective conductors of the cable; a plurality of contacts each including terminal means adapted for insertion into a respective one of the recesses for effecting electrical connection to the respective conductor interiorly of the body and connecting means for electrically connecting with an external conductive member; and cover means attached to the base and engageable with at least a part of the contacts for holding the contacts to the base.

Further in accordance with the invention there is provided an electrical cable/connector assembly comprising a cable including a plurality of generally parallel conductors and insulation therefor; a strain relief base molded onto the cable, the base including a plurality of externally opening recesses aligned with respective conductors of the cable; a plurality of contacts each including terminal means adapted for insertion into a respective one of the recesses for effecting electrical connection to the respective conductor interiorly of the base and connecting means for electrically connecting with an external conductive member; and means molded independently of the base and attached to the base operative upon at least a part of the contacts to hold the contacts to the base.

Also provided is a method of making a cable/connector assembly comprising the steps of molding a strain relief base onto a cable of the type including a plurality of generally parallel conductors and insulation therefor, the base having formed therein a plurality of externally opening recesses aligned with respective conductors of the cable; inserting into the recesses terminal portions of respective contacts to make electrical connection with the respective conductors interiorly of the base with a contacting portion of the contacts located externally of the base; and attaching to the molded base a cover operative to engage a part of the contacts to hold the contacts to the base.

An aspect of the invention relates to particular configurations of the IDC terminal portions of the contacts for a cable termination of the type described.

An aspect of the invention relates to the rotated/twisted arrangement of conductor pairs of a ribbon cable and the securement thereof in a directly molded strain relief body of a cable termination assembly, particularly one in which IDC techniques are used to connect the contacts of such assembly to the respective conductors.

A number of advantages inure to the aforementioned cable cable/connector device described in detail herein, including the strong securement of the conductors in the strain relief body, including at the ends thereof, while minimizing the size of the body and, thus, facilitating use in a true side and end stackable relation with other such assemblies and the ability conveniently effectively to spread the conductors of a ribbon cable to facilitate the making of IDC junctions between respective contacts and cable conductors, particularly in minimum space.

Another advantage of the invention is the ability to minimize space required for cable conductors and IDC junctions while permitting use of relatively strong contacts preferably with dual support of the contact wiping (connecting) portion.

Another aspect relates to a method for making at least part of a cable termination assembly by effecting rotating/twisting of pairs of insulated conductors of a ribbon cable during the closure of a mold, using the twisting mechanism to effect a shut off function for such mold and to define recesses or openings in a strain relief body molded directly to the cable using such mold, and effecting such molding.

A further aspect relates to apparatus for making at least part of a cable termination assembly including a mold for molding a strain relief body to a multiconductor cable, such as a ribbon cable, and a core arrangement for twisting respective pairs of insulated conductors of the cable to be generally coplanar in a plane that is at least approximately normal to the major end to end direction of the strain relief body, and the core arrangement also providing a shut off mechanism relative to such insulated conductors to provide recesses or openings in the strain relief body to permit insertion thereinto of respective contact terminal portions for IDC engagement with the respective conductors.

Still another aspect relates to the overflow molding of a secondary strain relief portion of a cable termination assembly directly to at least the main strain relief body, contacts and an end cap or cover to provide an integral structure thereof.

The foregoing and other features of the invention are hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 1 is a front elevational view of a cable/connector assembly according to the invention;

FIG. 2 is an end elevational view of the assembly looking generally in the direction of the arrows 2—2 of FIG. 1;

FIG. 3 is a bottom plan view of the assembly looking generally in the direction of the arrows 3—3 of FIG. 1 and showing in phantom lines end and side stacked cable/connector assemblies of like type;

FIG. 4 is a sectional view through the assembly of FIGS. 1-3;

FIG. 5 is a fragmentary partial sectional view of the assembly taken substantially along the line 5—5 of FIG. 4;

FIG. 6 is a fragmentary sectional view of the assembly taken substantially along the line 6—6 of FIG. 4;

DETAILED DESCRIPTION

Figure 7:
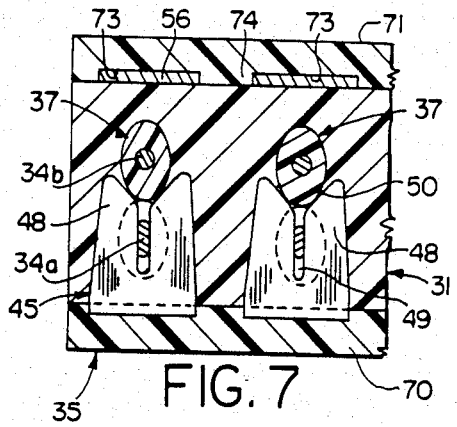
FIG. 7 is an enlarged fragmentary sectional view of the assembly taken substantially along the line 7—7 of FIG. 6.

Referring now in detail to the drawings and initially to FIGS. 1-7, a multi-conductor electrical cable/connector assembly according to the invention is designated generally by reference numeral 30. The connector 30 comprises a strain relief base 31 of electrically non-conductive material molded onto a flat ribbon multi-conductor electrical cable 32, a plurality of electrical contacts 33 for connection at respective electrical junctions to respective conductors 34 of the cable to form a base/contact/cable sub-assembly, and a cover 35 of electrically non-conductive material installable over the base/contact/cable sub-assembly to form a mechanically integrated structure therewith.

In the illustrated embodiment, the cable 32 is a conventional PVC ribbon cable including polyvinylchloride insulation which maintains the conductors 34 in parallel spaced-apart, electrically isolated relationship on 0.050 inch centers. The cable insulation, however, is severed at its region to which the base 31 is molded, as along tear down separations 36, to form separated insulation portions 37 each containing portions 34*a*, 34*b* of a respective pair of conductors as best seen in FIG. 7. Each insulation portion 37 is twisted, as seen at 38 in FIG. 6, to reorient the conductor portions therein at right angles to their original orientation in the plane of the cable with one conductor portion 34*a* being forwardly offset from the center plane of the cable and the other conductor portion 34*b* being rearwardly offset from the center plane of the cable. Accordingly, there is provided a front row of conductor portions 34*a* and a rear row of conductor portions 34*b*, and the center-to-center spacing of the conductor portions in each row is twice the center-to-center spacing of adjacent conductors in the unsevered portion of the cable. Such orientation of the conductor portions 34*a*, 34*b* is maintained by the base 31 molded thereon, and the material of the molded base 31 preferably is a thermoplastic material that is compatible with and will chemically bond to the cable insulation when molded thereon to provide a strong interconnection that precludes separation of the base member 31 from the cable 32.

With particular reference to FIGS. 4, 6 and 7, the strain relief base 31 has formed therein two rows of spaced apart recesses or holes, the holes 42*a* opening to a herein denoted front surface 43 of the base and the holes 42*b* in the other row opening to a herein denoted rear surface 44 of the base. The holes 42*a*, 42*b* are configured to receive, guide, locate and hold terminal portions 45 of respective contacts 33*a*, 33*b* which are correspondingly arranged in front and rear rows in a dual-in-line pattern. The holes 42*a* receiving terminal portions 45 of the front row of contacts 33*a* are aligned with and extend inwardly to respective ones of the forwardly disposed conductors 34*a* whereas the recesses 42*b* receiving terminal portions of the rear row of contacts 33*b* are aligned with and extend inwardly to respective ones of the rearwardly disposed conductors 34*b*. As seen in FIG. 4, the two rows of holes are vertically offset from one another, i.e., disposed in respective planes spaced apart from one another along the longitudinal extent of the conductors, to obtain desired insulated isolation of the terminal portions of oppositely disposed front and rear contacts 33*a*, 33*b*. Accordingly, the terminal portions forming electrical junctions with a respective pair of conductors 34*a*, 34*b* can extend inwardly into overlapping relationship without contacting one another because of their retention in the vertically offset holes 42*a*, 42*b* in the base. That is, the overlapping portions of such terminal portions will be located one atop the other with a portion of the molded base located therebetween to provide insulated isolation of such overlapping portions.

The terminal portion 45 of each contact 33 includes, as best seen in FIG. 7, a pair of elongate prong-like arms 48. The arms 48 form therebetween a narrow slot 49 which opens to a progressively widening entranceway 50. The entranceway 50 serves to guide the respective conductor into the narrow slot 49 as the terminal portion is inserted into the respective hole 42 during assembly of the contacts to the base 31. The narrow slot preferably is narrower than the normal diameter of the conductor so that some flattening of the conductor occurs to provide a relatively enlarged surface area of engagement or connection between the conductor and the arms 48.

The terminal portions 45 of the contacts and the holes 42 in the base 31 preferably are correspondingly configured widthwise (left to right in FIG. 7) for close laterally locating receipt of the terminal portions in the holes. With regard to the formation of the holes during molding of the base onto the cable, the mold parts are provided with hole forming core elements projecting into the mold cavity which core elements preferably have a widthwise configuration similar to that of the terminal portions except that the narrow slots in the core elements preferably have a width equal to or slightly greater than the normal diameter of the conductors. Accordingly, the core elements will partly displace the insulation surrounding the conductors as the mold is closed while leaving the conductors essentially undisturbed, i.e., without causing any substantial distortion of the cross-sectional shape of the conductors. This is to avoid preflattening of the conductors which could result in electrical junctions not as good as those formed when the terminal portions effect final displacement of the insulation and flattening of the conductors between the arms thereof.

The contacts 33 preferably are identical and, as seen in FIGS. 4–7, each contact includes in addition to the terminal portion 45 a base portion 56, an intermediate sloping portion 57, a leg portion 58 and a reduced width extension 59 of the leg portion which is reversely bent back over the leg portion 58 to form a wiping arm. The contacts generally are elongate flat strips of conductive metal bent as illustrated in FIGS. 4–7.

The terminal portion 45 of each contact 33 extends generally at right angles to the base portion 56 such that when the terminal portion is received in a respective hole 42 in the base 31, the contact base portion 56 will be in juxtaposition with the front surface 43 of the base in the case of the forward row of contacts 33*a* or with the rear surface 44 of the base in the case of the rear row of contacts 33*b*. The intermediate portion 57 slopes inwardly and downwardly from the base portion 56 to the leg portion 58 which extends generally parallel to the base portion 56. Because of the vertically staggered relationship of the contacts 33*a*, 33*b* in the front and rear rows, the base 31 has a bottom surface 60 which is downwardly sloped back to front to accommodate the intermediate portions 57 of the rear row of contacts 33*b*.

As seen in FIGS. 4–6, the leg portion 58 and wiping arm 59 of each contact 33 is contained in a respective chamber 64 formed in the lower or female socket portion of the cover 35. The cover 35 is molded as a separate part with chambers 50 arranged in the lower portion thereof in a dual-in-line pattern. The cover also includes in a bottom wall 65 thereof a plurality of apertures 66 for guiding respective external conductive elements such as pin contacts into respective chambers 64 for mechanical and electrical engagement with the wiping arms 59 of the respective contacts 33.

As best seen in FIG. 5, each chamber 64 preferably has a T-shape cross-section. The leg portion 58 of the respective contact 33 is locatingly received in the head portion of the T-shape chamber whereas the generally centered, reduced width wiping arm 59 of the contact is disposed in the stem portion of the T-shape chamber. The stem portion is dimensioned to receive a pin contact inserted therein through the respective aperture 56. As a pin contact is inserted into the chamber, it will engage and cause the wiping arm resiliently to deflect inwardly towards the leg portion. Upon full insertion of the pin contact into the chamber, the resiliency of the wiping arm will cause the wiping arm to be held in forced mechanical and electrical engagement with the adjacent side of the pin contact which, for example, may be a conventional square pin contact.

The cover 35 also has front and rear walls 70 and 71 extending upwardly from the lower or socket portion of the cover and adapted to be slipped over the base for effecting attachment of the cover to the base and also to hold the contacts at their base portions 56 to the base. The front and rear walls 70, 71 each have formed at inside surfaces thereof respective longitudinally extending channels 73 for accommodating the contact base portions 56 of the contacts 33 which are supported on the front and rear surfaces 43 and 44 of the base 31. The channels 73 preferably extend to the top of the cover to facilitate sliding of the cover over the base to which the contacts have been assembled. The channels 73 are laterally separated by longitudinally extending ribs 74 which engage the front and rear surfaces of the base and which are provided at their upper ends with inward latching protrusions 75 adapted to snap into respective recesses 76 formed in the front and rear surfaces of the base at the upper end of the base thereby to lock the cover to the base. It perhaps should be noted that the cover is made of a sufficiently resilient plastic material which allows the front and rear side walls 70 and 71 thereof to deflect resiliently outwardly to permit passage of the latching protrusions 75 over the front and rear surfaces of the base until they become aligned with and snap into the recesses 76 provided at the upper end of the base during installation of the cover onto the base.

Further with regard to assembly of the cable/connector assembly 30 illustrated in FIGS. 1–7, it should be evident that the insulation of the cable 32 is first severed and the insulation portions 37 rotated as aforedescribed prior to molding of the base 31 onto the cable. After the base has been molded onto the cable, the terminal portions 45 of the contacts 33 are then inserted into respective holes 42 in the molded base to mechanically and electrically connect the contacts to respective conductors 34 of the cable at respective electrical IDC junctions. To facilitate such inserting or pressing of the terminal portions into the holes to effect the IDC junctions with the conductors, the contacts of each row preferably are attached to a common carrier strip which maintains the contacts in a spaced relationship corresponding to the spacing between the holes in the base. After each row of contacts has been pressed into the base, the carrier strip may then be separated and, the wiping arms 59 which initially may reside in the plane of the carrier strip, may be bent over the leg portions 58 of the contacts. With the contacts thusly assembled to the base, the cover 35 may then be slipped over the portions of the contacts depending from the base and then over the base until locked in place.

The above described cable/connector assembly can be used to effect electrical connection of the cable conductors to other circuits as by coupling the connector to a mating connection device such as a pin header, for example. The cable/connector assembly may be also used to connect the cable conductors to respective pin contacts of a pin field along with other cable/connector assemblies which connect the conductors of the cables therein to respective different sets of pins in the pin field. In this latter regard, it is noted that the above described cable/connector assembly preferably is externally dimensioned for both end and side stacking with other similar connectors coupled to the pin field. In FIG. 3, there is shown in phantom lines at 80 an end-stacked connector and at 81 a side-stacked connector. Moreover, this is accomplished without disturbing the center-to-center spacing of pins in the rows or columns of the pin field spanned by two or more cable/connector assemblies according to the invention. More particularly, the cable/connector assembly may be used with a pin field wherein the contact pins are on 0.100 inch centers throughout the rows and columns of the pin field. More generally, outer side and end surfaces of the assembly are spaced from the centers of respective proximal access holes 66 by a distance no greater than one-half the center-to-center spacing of the access holes to which the effective centers of the contacting portions of the contacts are aligned.

It further will be appreciated that the contacts may be modified in various respects without deviating from the principles of the subject invention. For example, the lower or contacting portion of the contact may be of fork contact type with the cover being modified to accommodate such different type of contacting portin. Modification may also be made to provide a cable connector of male type such as where the contacting portions of the contacts are of pin type and project outwardly beyond a correspondingly modified cover. Still other modifications may become apparent from the preceding description and the following description of a modified cable/connector assembly according to the subject invention.

Figure 9:
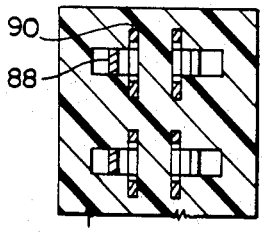
FIG. 9 is a fragmentary sectional view through the modified assembly taken substantially along the line 9—9 of FIG. 8.
Figure 8:
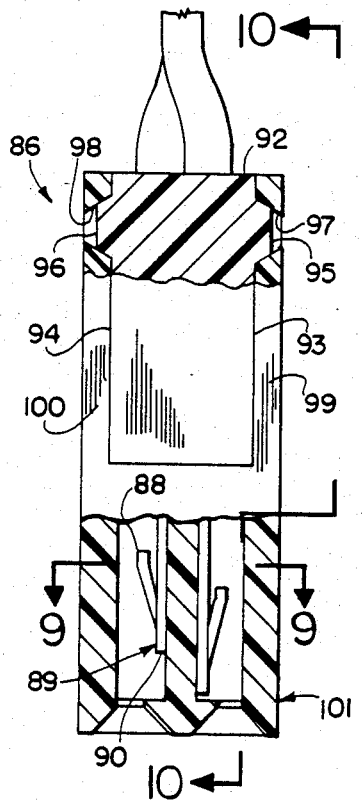
FIG. 8 is a part elevational/part sectional view of a modified cable/connector assembly according to the invention.
Figure 10:
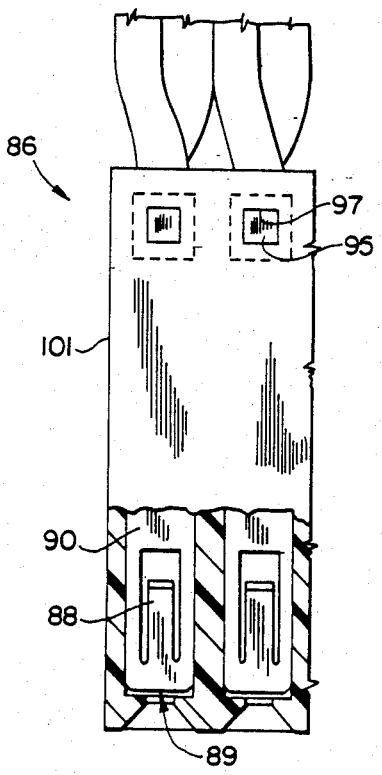
FIG. 10 is a part elevational/part sectional view of the modified assembly taken substantially along the line 10—10 of FIG. 8.
Figure 11:
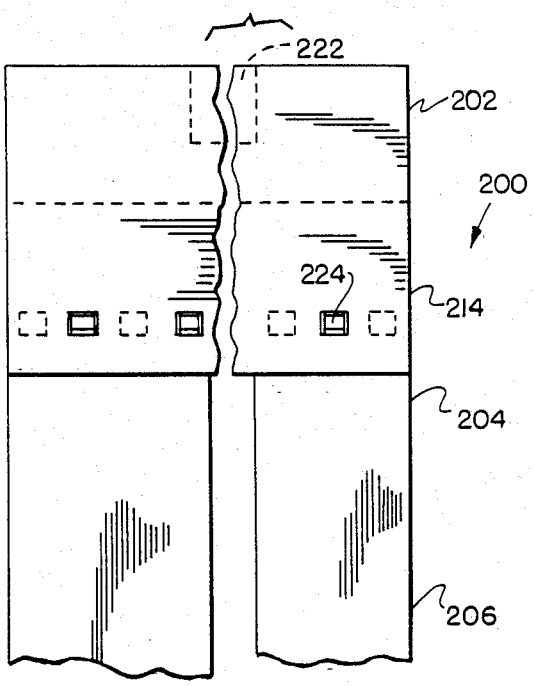
FIG. 11 is a side plan view of a cable termination assembly according to a preferred embodiment of the invention.
Figure 14:
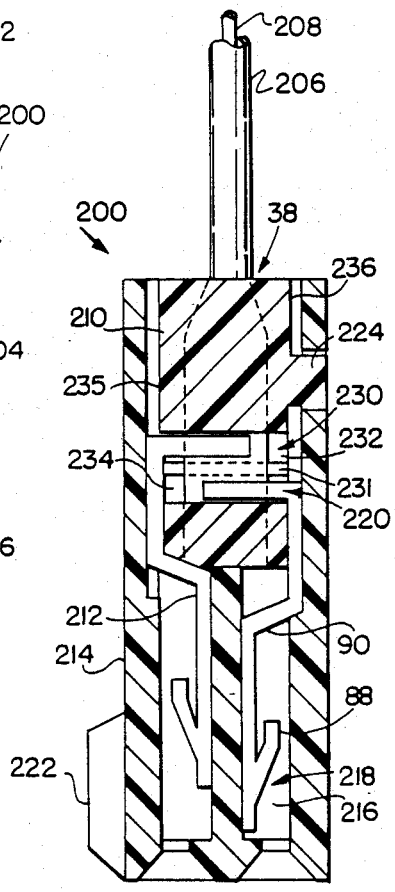
FIG. 14 is a section view of the assembly of FIG. 11 looking generally in the direction of the arrows 14—14 of FIG. 11.

Turning now to FIGS. 8–10, a modified cable/connector assembly according to the invention is generally illustrated at 86. The cable/connector assembly 86 is essentially identical to the above described cable/connector assembly 30 except for the following modifications.

One modification involves the formation of a wiping arm from the leg portion of each contact. As shown, the wiping arm 88 of each contact 89 is formed by an interior segment of the leg portion 90 which segment is partly severed from and bent out of the plane of the leg portion at its point of joinder to the leg portion.

The other modification involves the manner in which the cover is held onto the base. As seen in FIGS. 8 and 10, the base 92 has formed on its front and rear surfaces 93 and 94 respective plural latching protrusions or detents 95 and 96 adapted to be received in respective recesses or holes 97 and 98 in the front and rear walls 99 and 100 of the cover when the latter are slipped over the base. Preferably, at least the bottom side of each detent is sloped cammingly to cause the upper ends of the front and rear walls to flex outwardly as they pass onto the detent.

Turning, now, to FIGS. 11–17, a cable termination assembly 200 according to the preferred embodiment and best mode of the present invention is illustrated. Various parts of the assembly 200 are the same or similar to those employed in the cable/connectors 30, 86 of FIGS. 1 and 8, for example, as is evident from the drawings. The differences are described in detail below.

The assembly 200 includes a cable termination 202 and a flat ribbon multiconductor cable 204, for example of PVC insulation 206 and plural conductors 208 therein. The cable preferably is able to be slit to separate the conductors into respective pairs of adjacent conductor that are able to be rotated or twisted, as is described herein. It will be appreciated that although the preferred embodiment of the invention is described with respect to the flat ribboin multiconductor cable, various features and aspects of the invention may be embodied generally equivalently with assemblies that use either single conductor, multiconductor non-flat, discrete wire multiconductor, etc. cables.

The termination 202 primarily is formed of a strain relief body 210 directly molded to the cable 204 to form an integral structure therewith, plural electrical contacts 212 that are placed in IDC relation to form IDC junctions with respective conductors 208 of the cable, and a separate cover 214 that can be slid over at least part of the contacts and strain relief body for fastening with respect thereto.

The cover 214, which is illustrated in detail in FIGS. 11–14 and 22–25, has plural chambers 216 therein to receive the connecting ends 218 of the contacts, for example to protect the same from damage and to guide external members (such as pin contacts contained in a pin field) into electrical engagement therewith. The back end of the chambers 216 are relatively large to receive the relatively large cross sectional size and bent legs 90 of the contact 212 that support a resiliently deformable contact wiping arm 88. Details of the contact 212 are substantially the same as the contact 89 described above with respect to FIGS. 8-10. It is noted here that such contact 89, 212 is a relatively strong one capable of providing dual support for the wiping arm 88 by the legs 90; and use of such strong contact is especially possible due to the in-line placement of the wiping arm 88 and the conductor of the cable with which the respective contact is attached at the terminal portion 220 (preferably an IDC terminal portion to effect an IDC connection with the respective cable conductors 208. Near the front end of the cover, the chambers 216 are generally T-shape to provide support for the wide support legs 90 and the narrower wiping arm 88. The stem of each T-shape opening and the front apertures or openings 66 in the cover 214 provide space to receive a pin contact and to guide the same into electrical engagement with respective contacts 212. Moreover, the back portion of the cover helps to hold the IDC terminal portions of the contacts 212 in place, as is described earlier.

As is illustrated in several of the figures, the contacts 212, for example, are arranged in dual-in-line pattern. The contacts in one row are slightly higher than those in the adjacent row. One advantage to such staggered arrangement mentioned above is the ability to use the same contacts to effect IDC connections of different respective conductors of a conductor pair while avoiding short circuits. Another advantage is the ability to have a minimum insertion force, but a relatively high withdrawal force for pin contacts inserted into the connector 200. Specifically, upon insertion of the pin contacts arranged correspondingly in a pair of parallel rows will find the pin contacts in one row engaging the contacts 212 in one row; and after overcoming the force required to deform the wiping arms of such contacts 212 will tend to slide easily into the connector 200 until the pin contacts in the other row engage the wiping arms of the higher up contacts 212, when the same resistance to insertion will be experienced again. On the other hand, upon withdrawal, the frictional affects of both rows of contacts 212 will have to be overcome simultaneously.

Figure 13:
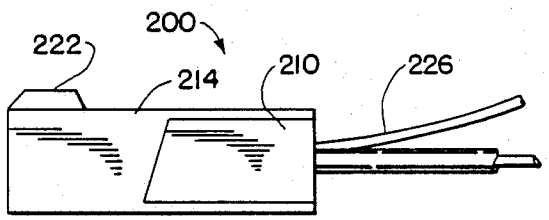
FIG. 13 is an end view of the assembly of FIG. 11.
Figure 12:
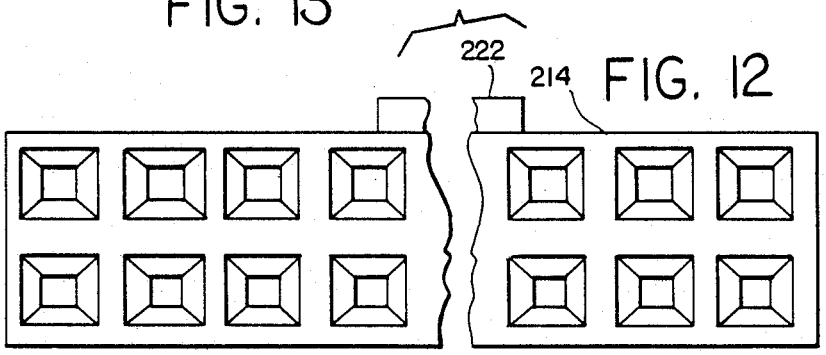
FIG. 12 is a front view of the assembly of FIG. 11.

A polarizing alignment key 222 is provided on the cover 214. Also, near the back end of the cover is an opening 97 to receive a ramp lock 224 of the strain relief body 210 to secure the cover to the strain relief body. Also, as is shown in FIG. 13, a pull tab 226 may be molded in place with the strain relief body to facilitate removing the connector 200 from connection with another connector, pin field, or the like.

Referring to FIGS. 14–17, the details of the strain relief body 210 are illustrated. The strain relief body preferably is directly molded to the cable 204 and preferably is of a material that will bond chemically to the cable insulation. Such material should have adequate electrical insulation/dielectric properties for the purpose for which the assembly 200 is intended. Details of the molding process and apparatus are described below with reference to FIGS. 18–21.

Figure 15:
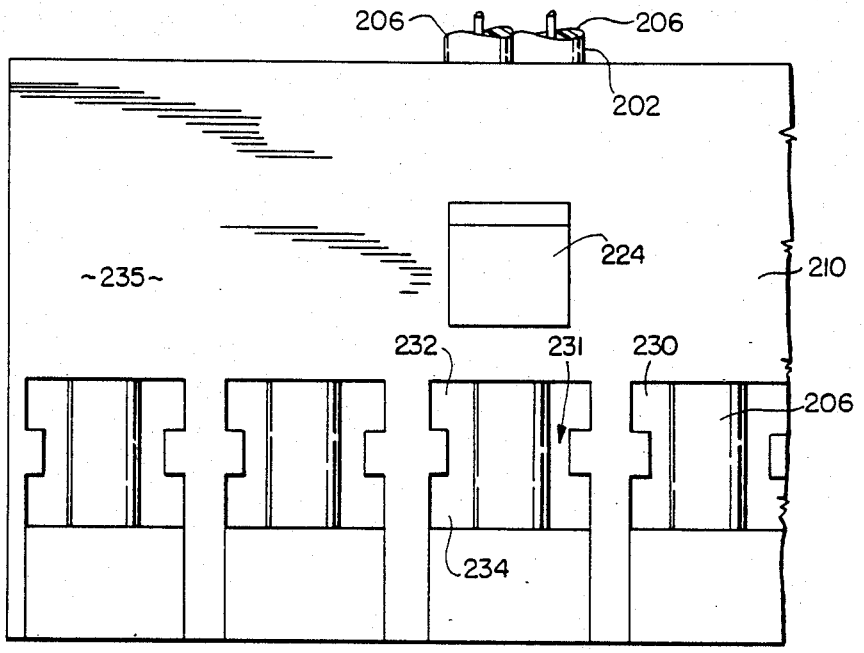
FIG. 15 is an enlarged partial side plan view of the strain relief body of the assembly of FIG. 11.
Figure 16:
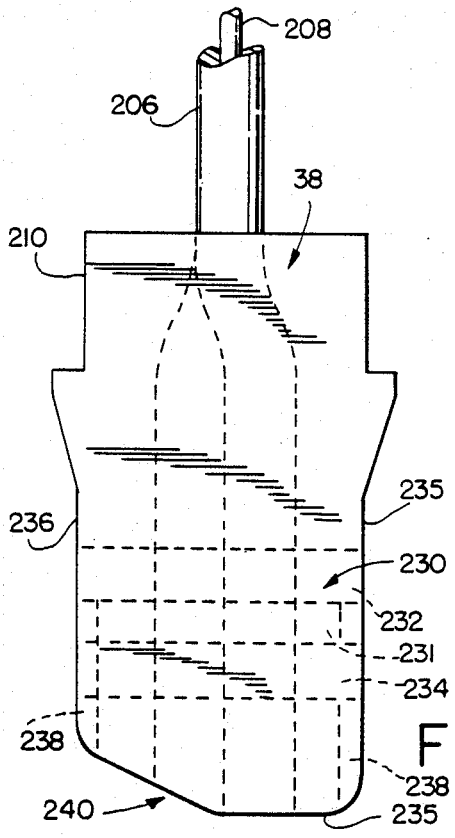
FIG. 16 is an end view of the strain relief body and cable looking generally in the direction of the arrows 16—16 of FIG. 15.

The strain relief body 210 is a generally solid body of material molded directly to the cable 204. The body 210 includes a plurality of the ramp lock surfaces 224 mentioned above to retain the cover 214 thereon. The body 210 also includes a plurality of openings or recesses 230 into which the terminal portions of respective contacts may be inserted to effect IDC connections with respective conductors generally as has been described above. The openings 230 are formed during molding of the strain relief body 210 using cores that make the openings barbell or I-shape. The narrow area 231 at the central portion of each opening vertically (as is illustrated in FIGS. 15 and 16, for example) spaces the larger open areas 232, 234 to help assure spacing of the contacts as they are inserted to engage the respective conductors within the strain relief body from opposite sides 235, 236 thereof. Typically, one (the higher or lower) of each such pair of opening areas 232,234 is used for the contacts on one side of the body 210 and the other is used for the contacts on the other side of the body for the desired IDC connection. Slots 238 are formed in the side surfaces of the strain relief body 210 to position and hold the contacts with respect thereto.

Figure 17:
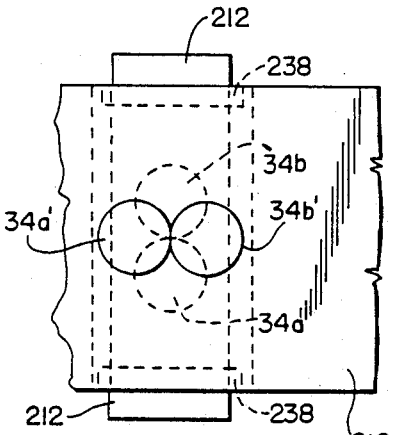
FIG. 17 is a partial back view of the strain relief body and cable looking in the direction of the arrows 17—17 of FIG. 15.

As is seen most clearly in FIGS. 16 and 17, the cable 204 is flat before it reaches the strain relief body 210. At the strain relief body until the end 240 of the cable, the cable insulation may be slit to divide the same into respective pairs of conductors, say conductors **34*a*, 34*b* (with accompanying insulation). Each respective pair of conductors is rotated or twisted about ninety degrees about the axis thereof so that the two conductors near the end 240 thereof are generally coplanar, but the plane in which they are located is normal or perpendicular to the major planar extent of the cable 204 and of the strain relief body 210. The position of the conductors 34*a*′, 34*b*′ in solid line in FIG. 17 indicates the pretwisted lay out of the conductors; the position of the conductors 34*a*, 34*b* in dotted lines in FIG. 17** depict the conductors within the strain relief body near that portion of the conductors where they have been fully twisted the aforementioned ninety degrees. With the conductors so twisted, the aforementioned IDC connections with respective contacts may be made.

Advantageously, by locating the area of twist 38 and any slit part of the cable 204 within the strain relief body 210, the slit will not propagate along the cable outside the strain relief body. With the twist provided, the effective distance between adjacent pairs of conductors may be 0.100 inch center to center, even though the actual conductor pitch in the flat ribbon cable 204 where it is not slit and twisted may be 0.050 inch, and this facilitates achieving the desired IDC connections.

Moreover, importantly, according to the present invention, by providing the twisting of the cable conductor pairs, the outboard-most conductors at the ends of the cable termination assembly 200 will be moved somewhat inboard. Such moving causes the IDC areas of such outboard-most conductors to be at a more inboard place in the strain relief body 210 so that the IDC junction formed therewith by respective contacts 212 will be within the strain relief body; the spacing of the contacts 212 at the outboard ends of the connector 200 will be adequately inboard so that good end stackability, especially with a cover 214 in place, is able to be achieved.

In FIGS. 18–21 a molding machine 260 for use to make the strain relief body 210 with the twisted cable conductor pairs therein is shown. The molding machine 260 includes a mold 262 formed by a movable A half mold 264 and a fixed B half mold 266, as is conventional in plastic injection molding machines. The mold halves may be closed to define a mold cavity in which part of the cable 204 is positioned and into which molding material may be injected to form the strain relief body directly about at least part of the cable in the mold. Generally shown in FIG. 18 as part of the molding machine 260 is control and motive apparatus 267 for opening and closing the mold 262 and injection apparatus 268 to control and to inject molding material into the mold 262. The various parts 267, 268 may be conventional to plastic injection molding art.

The molding machine 260 is operative to mold plastic using overflow molding technique, i.e. flowing plastic over the cable 204, to form the strain relief body. Such plastic flow is provided from the injection apparatus 268 via a conventional runner **269*r* and gate 269*g* flow system 269 in the mold 262, as is well known. A mold cavity is formed in the mold 262; one half 270 of the mold cavity is illustrated in the B half 266 of the mold 262 in FIG. 19; the other half of the mold cavity is in the A half 264. The total depth of the mold cavity when the mold 262 is closed would be the same as the desired thickness of the strain relief body 210. Moreover, a cable slot 271 is provided the mold in the A and B mold halves 264, 266 to receive the cable therein but not to permit molding material to flow therein. Such blockage of molding material into the cable slot 271*a* where the cable insulation is integral and unslit is not a problem because of the ability of the mold to close tightly against the cable insulation. However, at the cable slot area 271*b*** where the cable is slit and the respective conductor pairs have been twisted, further means described below is provided to effect the desired shut off function for the mold cavity.

Figure 20A:
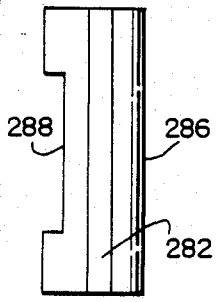
FIG. 20A is a section view of the core bars looking in the direction of arrows 20A—20A of FIG. 20.
Figure 21:
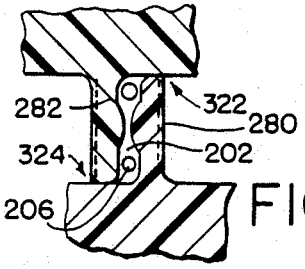
FIG. 21 is a partial view similar to FIG. 20 showing a pair of the core portions of the core bars in closed condition having rotated a pair of conductors, shut off against such conductors and shut off against the opposite core bar ready to undergo injection of molding material into the mold cavity.
Figure 22:
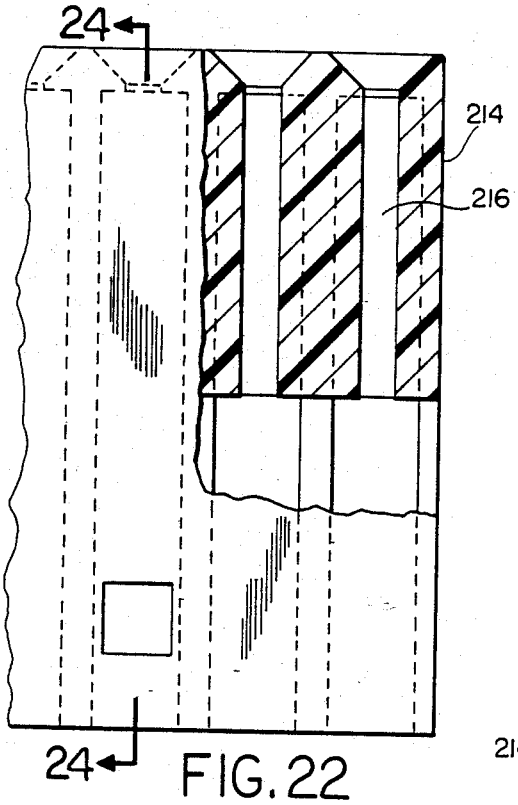
FIG. 22 is a top plan view partly in section of a cover for the assembly of FIG. 11.
Figure 25:
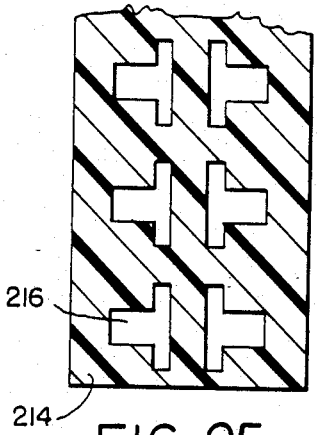
FIG. 25 is a section view of the cover looking generally in the direction of the arrows 25—25 of FIG. 24.
Figure 23:
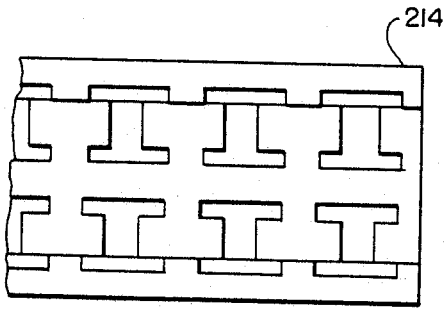
FIG. 23 is a bottom view of the cover of FIG. 22.
Figure 24:
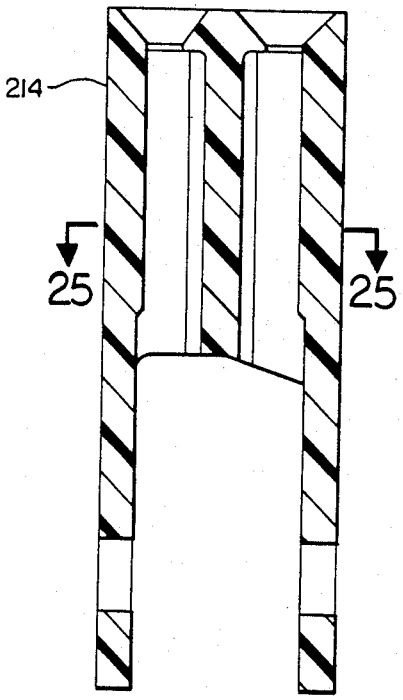
FIG. 24 is an end elevation section view of the cover looking generally in the direction of the arrows 24—24 of FIG. 22.

Importantly, the mold 262 includes four core bars 272, 274, 276, 278 respectively arranged in pairs for effecting twisting of the respective conductor pairs, as was mentioned above, and to effect a flow shut off functions as is described further below. The core bars 272, 274 have protruding fingers 280, 282 for twisting respective conductor pairs and for shutting off against the conductors to prevent plastic molding material from flowing into the area of the strain relief body where the openings 230 are to be formed. Preferably the fingers 280, 282 are identical; each is elongated about the thickness of the strain relief body 210 and each has a curved surface or bump 284, 286 in one surface thereof about half way along the length thereof. The curved bumps 284, 286 of respective adjacent fingers 280, 282 oppose or confront each other in such a way as to define an hour glass shape when the mold 262 is closed with the adjacent teeth of respective pairs of core bars overlapping, generally as is illustrated in FIG. 21. Each of the fingers 280, 282 also has a channel 288 (FIG. 20A) on the otherwise smooth surface thereof, i.e. the surface opposite that from which the respective bump protrudes. Such channel 288 cooperates with a confronting channel on the adjacent tooth when the mold 262 is closed to allow molding material to flow therein so as to define the relatively narrower area 231 of the respective openings 230.

Figure 18:
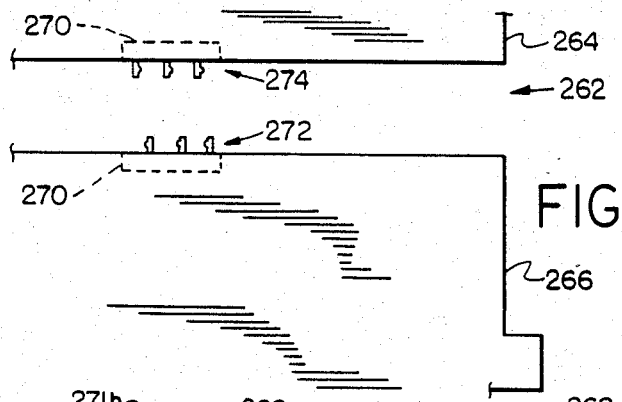
FIG. 18 is a partial side elevation view of a mold according to the invention for making the assembly of the preferred embodiment and for carrying out the method of the invention.
Figure 20:
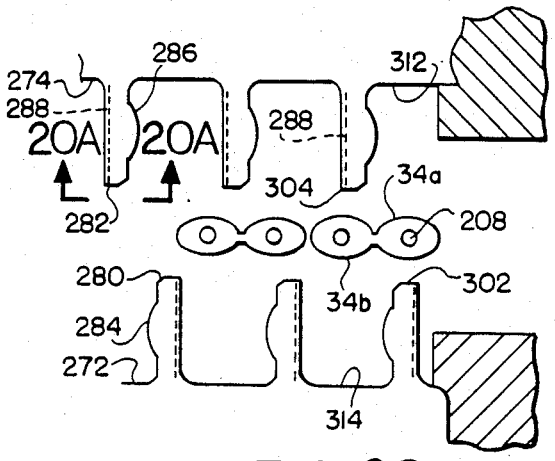
FIG. 20 is an enlarged partial side elevation view of the mold of FIG. 18 in open condition showing the plural core bars prepared to effect rotating/twisting of a cable placed therebetween.

With the mold 262 open, as is illustrated in FIGS. 18 and 20, the tips 302, 304 of respective adjacent fingers 280, 282 of the pair of core bars 272, 274 are positionally aligned with respect to a pair of conductors 34*a*, 34*b* that are intended to be twisted. As the mold 262 is closed, the tips 302, 304 press against the pair of conductors and rotate or twist the same until the twisted arrangement and relation illustrated in FIG. 21 is achieved. The cross sectional dimension of the larger chambers of the hour glass shape defined by the fingers 280, 282, bumps 284, 286 and other portions of the core bars 272, 27, as is shown in FIG. 21, is slightly smaller than the thickness of the cable insulation so as to achieve some compression by the fingers 280, 282 shutting off against the insulation to prevent molding material from reaching the cable insulation there. The tips 302, 304 of the fingers 280, 282 also engage the respective opposed shut off surfaces 312, 314 of the opposite core bar to effect a shut off function in the zones 322, 324 depicted in FIG. 21. Such shut off functions help assure the substantially full exposure of the cable conductors 34a, 34b and surrounding insulation in the each respective opening 230 in the strain relief body 210 for the IDC connection.

Figure 19:
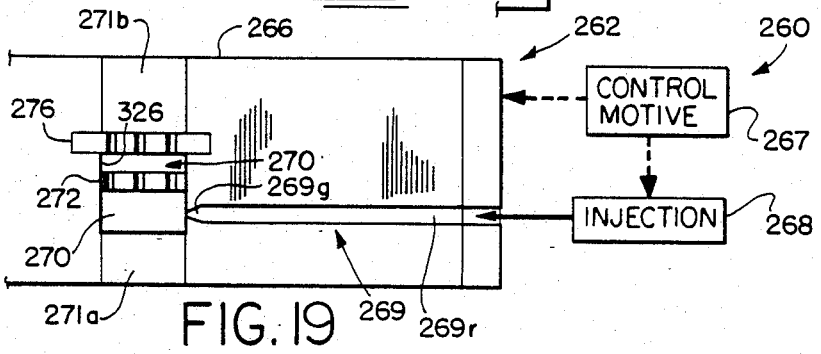
FIG. 19 is a top plan view of the bottom or B half of the mold looking generally in the direction of the arrows 19—19 of FIG. 18.

The core bars 276, 278, which are not shown in detail, are similar to the core bars 272, 274 in having fingers or other means to define slots with bumps like the bumps 284, 286 to twist the respective conductor pairs of the cable and to engage the conductors in a manner similar to the engagement illustrated in FIG. 21. Such engagement provides a shut off function with respect to the cable, the opposed core bar, and the proximate walls of the mold cavity 326, which is seen in FIG. 19 at the end of the mold cavity 270, for example, adjacent the cable slot portion 271*b*. The actual shape of the parts of the core bars 276, 278 may be selected to achieve the desired shape of the remote end 325 (as is seen in FIG. 16, for example) of the strain relief body. After completion of the molding of the strain relief body 210, the end of the cable 204 that may be exposed beyond such remote end 325 of the strain relief body may be cut off.

Summarizing the process by which the cable termination assembly 200 is made, initially the cable 204 is appropriately slit to form the respective conductor pairs. Such cable is placed in the mold 262 so that the initial part of each slit is within the mold cavity and respective conductor pairs are aligned with respect to the core bar fingers of both pairs 272, 274 and 276, 278 of core bars in the manner illustrated in FIG. 20. The mold 262 is closed under control of the control and motive means 267, as the conductor pairs are twisted and the shut off functions described above are achieved. Molding material, e.g., plastic or plastic-like material, is injected through the runner 269*r* and gate 269*g* into the mold cavity to fill the vacant areas of the mold cavity. After the molding material has solidified, the mold 262 is opened and the cable 204 and strain relief body 210 molded thereto are removed, and any extra cable protruding from the remote or forward end of the strain relief body may be cut off. The contacts 212 then may be inserted into respective openings 230 to form IDC junctionns with respective conductors. Finally, the cover 214 is installed to hold the contacts in place and to provide the guidance function for pin contacts or other external members that are intended to be connected to the contacts 212.

Figure 26:
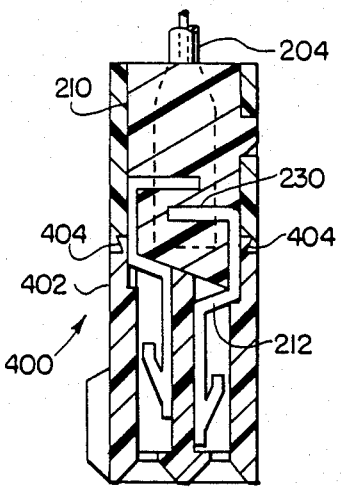
FIG. 26 is a section view of an alternate embodiment of cable termination assembly employing a directly second strain relief body.

Briefly referring to FIG. 26, a modified cable termination assembly 400 is illustrated. The assembly 400 is substantially the same as the assembly 200 described above. However, the cover 402 is truncated and is stepped at 404 to form a locking recess like half a dove tail conection, and a second strain relief body 404 is molded in place over part of the strain relief body 210, part of the contacts 212, and part of the cover 402 to secure the same as an integral structure. Part of the second strain relief may penetrate the openings 230 to secure the contacts 212 in the respective IDC junction relationship with respect to the cable. The second strain relief being directly molded to the parts indicated may provide added strength and integrity and enhanced electrical properties for the assembly 400.

Figure 28:
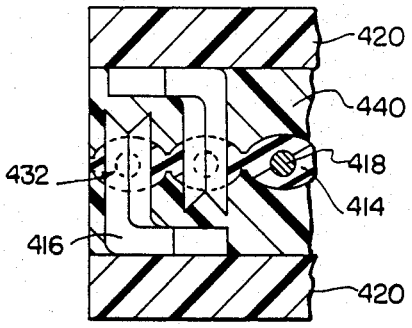
FIGS. 27–29 are fragmentary side, end and back section views showing an alternate form of IDC connection between the contacts and cable conductors together with a twisted tine fork contact arrangement.
Figure 27:
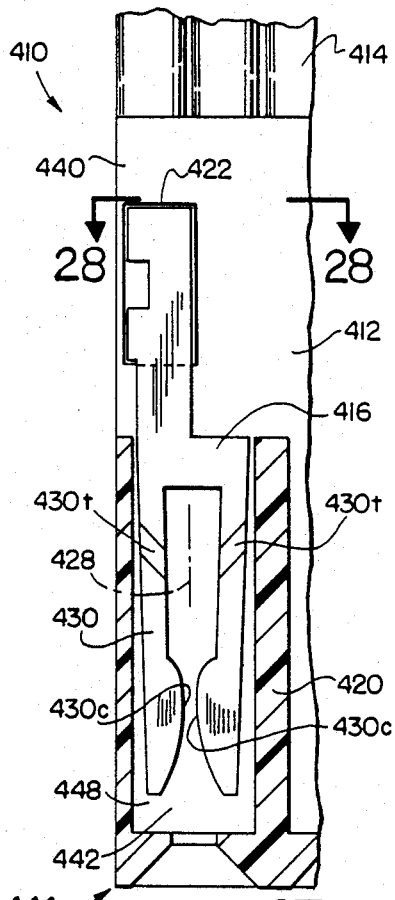
Figure 29:
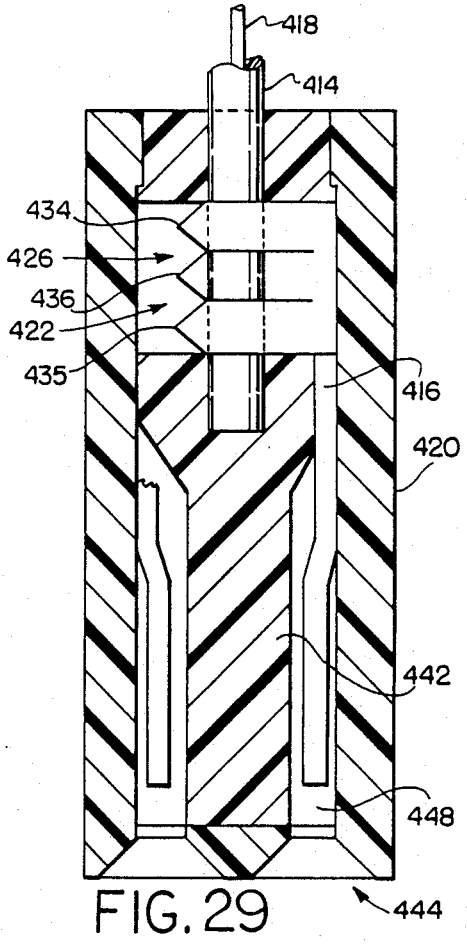

In FIGS. 27–29 a modified embodiment of side and end stackable cable termination assembly 410 is illustrated. The assembly 410 includes a strain relief body 412 directly molded to a flat multiconductor cable 414, plural electrical contacts 416 that effect IDC conections with respective cable conductors 418, and a cover 420 that may be slid over the assembled contacts, strain relief body and cable, as is illustrated. Portions of the several parts illustrated in FIGS. 27–29 have been broken away to enable viewing of other parts in multiple planes for convenience of illustration and understanding of the invention; for example, in FIG. 29 only part of one of the contacts 416 on the left side is shown. Also, for convenience of seeing part of the strain relief body, only one of the contacts is illustrated in FIG. 27.

The strain relief body 412 preferably is plastic injection molded over the cable leaving one row of slot-like openings 422 on each side of the strain relief body for access to the cable by the IDC terminal portions 426 of the contacts 416 to make IDC junctions with such conductors generally as was described above. Importantly in this embodiment, the IDC terminal portions 426 are offset relative to the central axial line 428 or extent of each of the contacts 416, e.g., between the contact tines 430 thereof. Such offset, and the corresponding offset positioning of the openings 422, permits the same style or shape contacts to be used on both sides of the assembly 410, as is illustrated, while also achieving effecting separation of the connections to respective cable conductors to avoid short circuits. The actual IDC junctions 432 between respective conductors 418 and IDC terminal portions 426 are seen in FIGS. 28 and 29.

The IDC terminal portion 426 of the contacts has three protruding tine-like points or members 434, 435, 436. The points 434, 435 are coplanar and that plane is generally parallel with the axis 428 of the contact; the point 436 is slightly offset from the points 434, 435 out of the mentioned plane. Therefore, to achieve the IDC connection of the contact 416 with the conductor 418, the points 434, 435 penetrate the cable insulation generally on one side of the conductor as the point 436 penetrates on the other side; the result is a distorting of the conductor and an engagement thereof with the respective points. If the conductor is stranded type, the protrusions or points 434–436 may actually penetrate into engagement with several or the strands. The opening 422 preferably is adequately large to receive all of the mentioned points, as is seen most clearly in FIG. 29.

It also is noted here that the strain relief base is molded with an encapsulating portion 440 about the cable 414 and with a carrier or support 442 that extends forwardly of the end of the cable to the front 444 of the assembly 410. The carrier 412 separates respective rows of contacts and also cooperates with the cover 420 to form respective cells or chambers 448 into which respective pin contacts or other external members may be inserted for connection to respective contacts 416. Further, as is illustrated, the tines 430 are of the rotated fork contact type. Gold inlay material may be placed in one surface of the material from which the contacts are to be formed; then the contact may be cut, bent to form the rounded contacting areas 430*c* and twisted at the area 430*t* about ninety degrees to place the gold inlay material and contacting areas 430*c* in position to engage a pin contact inserted into the fork contact.

Figure 31:
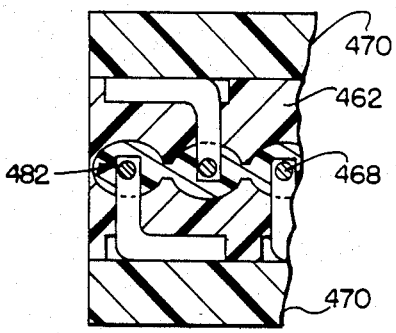
FIGS. 30–32 are fragmentary side, end and back section views showing another alternate form of IDC connection between the contacts and cable conductors together with a mechanism for securing the terminal portions of the contacts in the strain relief body.
Figure 30:
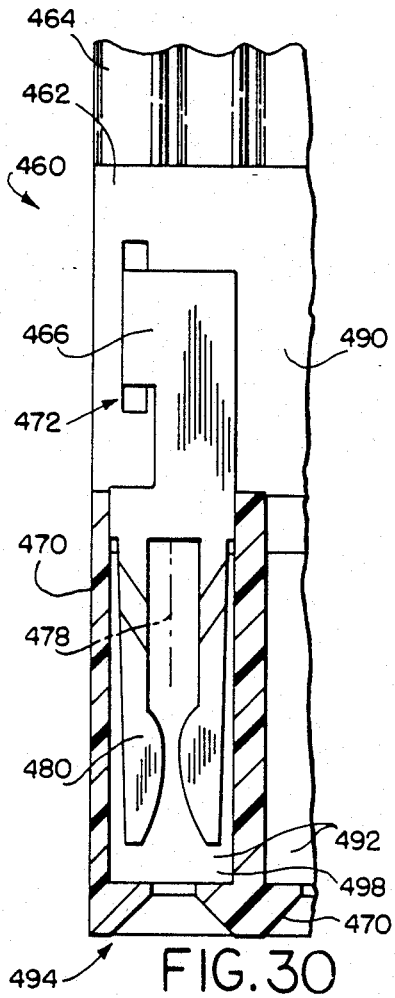
Figure 32:
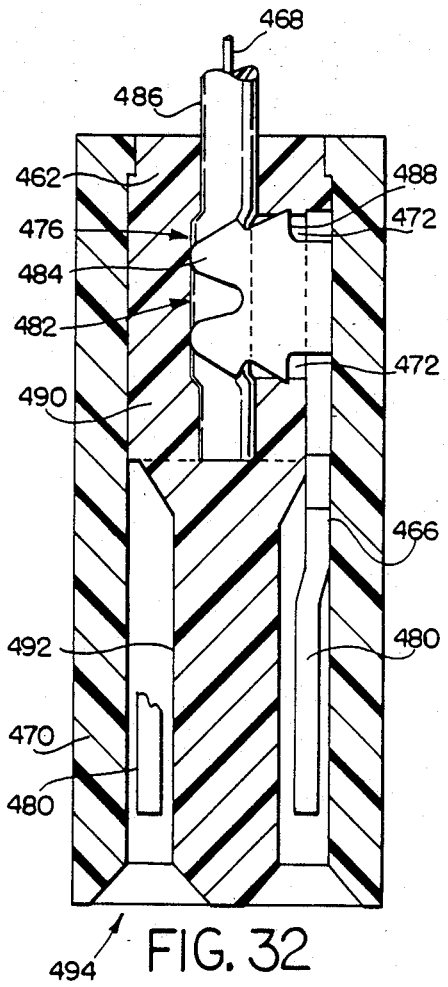

Turning to FIGS. 30–32, a further modified embodiment of side and end stackable cable termination assembly 460 is illustrated. The assembly 460 includes a strain relief body 462 directly molded to a flat multiconductor cable 464, plural electrical contacts 466 (only one contact is shown in FIG. 30 for convenience and clarity of the illustration) that effect IDC connections with respective cable conductors 468, and a cover 470 that may be slid over the assembled contacts, strain relief body and cable, as is illustrated. Portions of the several parts illustrated in FIGS. 30–32 have been broken away to enable viewing of other parts in multiple planes for convenience of illustration and understanding of the invention; for example, in FIG. 30, only part of the cover 470 is shown, and in FIG. 32 only part of one of the contacts is shown. Also, for convenience of seeing part of the strain relief body, only one of the contacts is illustrated in FIG. 30.

The strain relief body 462 preferably is plastic injection molded over the cable leaving one row of slot-like openings 472 on each side of the strain relief body for access to the cable by the IDC terminal portions 476 of the contacts 466 to make IDC junctions with such conductors generally as was described above. Importantly in this embodiment, the IDC terinal portions 476 are offset relative to the central axial line 478 or extent of each of the contacts 466, e.g., between the contact tines 480 thereof. Such offset, and the corresponding offset positioning of the openings 472, permits the same style or shape contacts to be used on both sides of the assembly 460, as is illustrated, while also achieving effective separation of the connections to respective cable conductors to avoid short circuits. The actual IDC junctions 482 between respective conductors 468 and IDC terminal portions 476 are seen in FIG. 31.

The IDC terminal portion 476 of the contacts has a pair of generally coplanar protrusions or bumps 484 that are adequately sharp to penetrate the cable insulation 486 to enter into engagement with the conductor therewithin. If the conductor is stranded type, the protrusions preferably actually penetrate into engagement with several or the strands. The leading tips of the protrusions may be slightly rounded as is shown rather than sharp so as to avoid breaking the conductors when inserted into engagement therewith. The IDC terminal portion 476 also has several barb-like protrusions 488 for locking into the plastic material bounding the openings 472 to lock the contact in place in the strain relief body in IDC connection with a respective conductor.

It also is noted here that the strain relief base is molded with an encapsulating portion 490 about the cable 464 and with a carrier or support 492 that extends forwardly of the end of the cable to the front 494 of the assembly 460. The carrier 492 separates respective rows of contacts and also cooperates with the cover 470 to form respective cells or chambers 498 into which respective pin contacts or other external members may be inserted for connection to respectiv contacts 466. Further, as is illustrated, the tines 480 are of the rotated fork contact type as was mentioned above.

Figure 34:
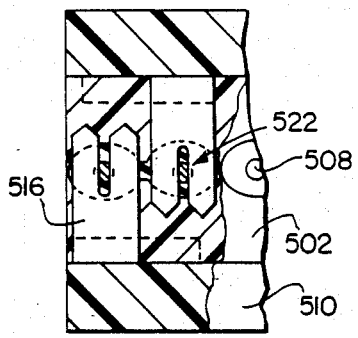
FIGS. 33–35 are fragmentary side, end and back section views showing still another alternate form of IDC connection between the contacts and cable conductors together with an offset arrangement of the terminal portions of the contacts.
Figure 33:
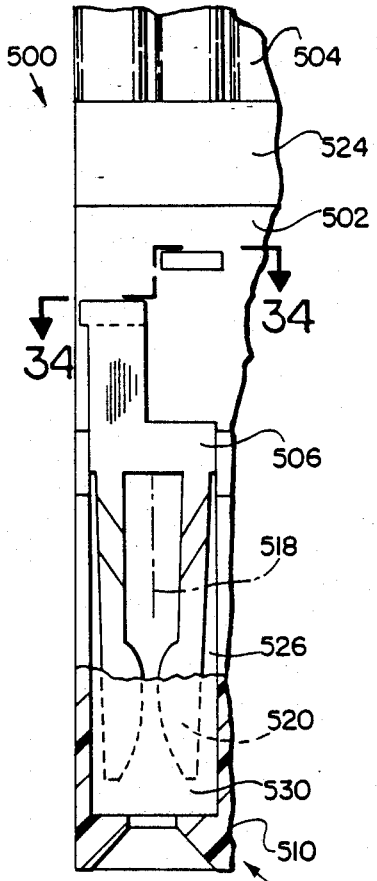
Figure 35:
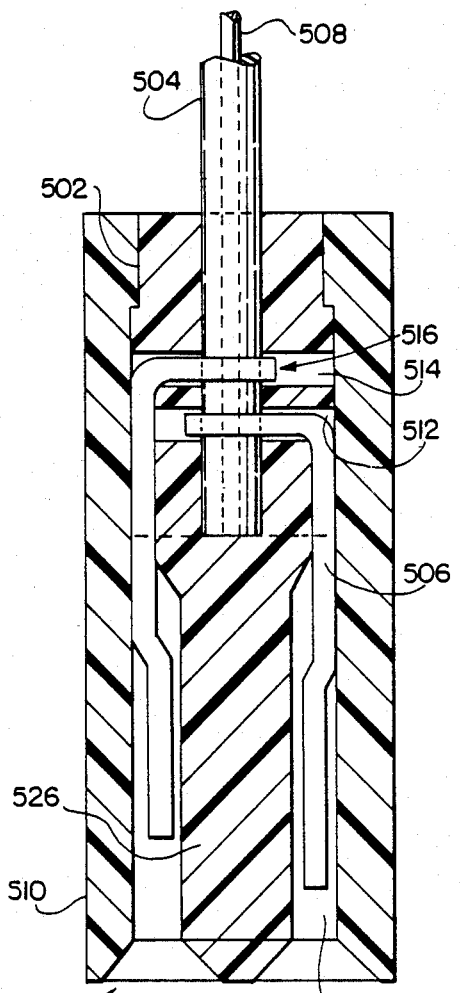

Briefly referring to FIGS. 33–35, a still further modified embodiment of side and end stackable cable termination assembly 500 is illustrated. The assembly 500 includes a strain relief body 502 directly molded to a flat multiconductor cable 504, plural electrical contacts 506 that effect IDC connections with respective cable conductors 508, and a cover 510 that may be slid over the assembled contacts, strain relief body and cable, as is illustrated. Portions of the several parts illustrated in FIGS. 33–35 have been broken away to enable viewing of other parts in multiple planes for convenience of illustration and understanding of the invention.

The strain relief body preferably is plastic injection molded over the cable leaving two rows of slot-like openings 512, 514 for access to the cable by the IDC terminal portions 516 of the contacts 506 to make IDC junctions with such conductors generally as was described above. Importantly in this embodiment, the IDC terminal portions 516 are offset relative to the central axial line 518 or extent of each of the contacts 506, e.g., between the contact tines 520 thereof. Such offset, and the corresponding offset positioning of the openings 512, 514, permits the same style or shape contacts to be used on both sides of the assembly 500, as is illustrated, while also achieving effective separation of the connections to respective cable conductors to avoid short circuits. The actual IDC junctions 522 between respective conductors 508 and IDC terminal portions 516 are seen in FIG. 34.

The strain relief base is molded with an encapsulating portion 524 about the cable 504 and with a carrier or support 526 that extends forwardly of the end of the cable to the front 528 of the assembly 500. The carrier 526 separates respective rows of contacts and also cooperates with the cover 510 to form respective cells or chambers 530 into which respective pin contacts or other external members may be inserted for connection to respective contacts 506. Further, as is illustrated, the tines 520 are of the rotated fork contact type mentioned above.

Although the invention has been shown and described with respect to certain preferred embodiments, it is evident that equivalent alterations and modifications will occur to others skilled in the art upon reading and understanding of this specification. The present invention includes all such equivalent alternations and modifications, and is limited only by the scope of the following claims.

What is claimed is:

1. A method of making a cable termination assembly that includes plural electrical conductors and respective contacts for connecting such conductors with external conductive members, comprising placing part of such cable in a mold, rotating/twisting at least one pair of conductors of such cable during the closure of such mold, molding a strain relief body to the cable using such mold, using the rotating/twisting mechanism to effect a shut off function for such mold to define recess openings in such strain relief body for access to respective conductors.

2. The method of claim 1, said molding comprising overflow molding using plastic injection molding techniques to mold such strain relief body directly to such cable.

3. The method of claim 1, said molding comprising substantially fully enclosing the cable conductors at the area of rotation/twist thereof.

4. The method of claim 1, further comprising inserting terminal portions of electrical contacts into respective recess openings to form IDC junctions with respective cable conductors.

5. The method of claim 4, further comprising applying a cover to such strain relief body and electrical contacts to hold the contacts in such IDC relation with respect to such conductors.

6. The method of claim 4, further comprising applying a cover to such strain relief body and electrical contacts, and molding a second strain relief body to at least part of such strain relief body, contacts and cover to hold the same as an integral structure.

7. A cable termination assembly that comprises a cable including plural insulated electrical conductors, and respective contacts for connecting the conductors with external conductive members, said assembly being made by the process comprising the steps of:

placing part of the cable in a mold, closing the mold, rotating/twisting at least one pair of conductors of the cable by means of a rotating/twisting mechanism during closing of the mold, molding a strain relief body to the cable using the mold, using the rotating/twisting mechanism to effect a shut off function for the mold to define recess openings in the strain relief body for access to respective conductors.

8. Apparatus for making at least a part of a cable termination assembly that comprises a cable including plural electrical conductors, and respective contacts for connecting the conductors with external conductive members, said apparatus comprising:

molding means for molding a strain relief body directly to the cable, rotating/twisting means for rotating/twisting at least one pair of connectors of the cable during closing of said molding means, said rotating/twisting means including shut off means for shutting off flow of molding material to define recess openings in the strain relief body for access to respective ones of the conductors or said one pair.

9. The apparatus of claim 8, wherein said rotating/twisting means comprises plural mold core means for cooperating with each other to engage, to rotate, and to shut off against the conductors of said one pair.

10. The apparatus of claim 9, wherein said plural mold core means comprise plural core bars each including means for shutting off against the other to block flow of molding material during molding of the strain relief body, whereby due to the shut off capability of said core bars in cooperation with the conductors recess openings are formed in the strain relief body for access to the conductors for insulation displacement connection.

11. The apparatus of claim 9, wherein insulation surrounds the conductors of said one pair, and said plural mold core means comprises means for engaging the insulation to effect at least slight deformation thereof to effect the shut off function.

12. The apparatus of claim 11, wherein a pair of said means for engaging forms an hour glass shape opening for containing therein the conductors of said one pair and the insulation surrounding the conductors.

13. The apparatus of claim 9, wherein said plural mold core means comprise two pairs of cores, said two pairs of cores being positioned to engage the insulated conductors of said one pair at spaced apart locations along the length of the conductors to form recess openings in the strain relief body which are spaced apart along the length of the conductors.

14. The apparatus of claim 13, wherein each of said pairs of cores is operative to hold the conductors of said one pair in coplanar relation to each other in a plane that is normal to a major planar extent of the strain relief body.

15. The apparatus of claim 14, including two pairs of cores for respective pairs of conductors of the cable, the cable being a ribbon cable having at least four conductors and a major planar extent, each said two pairs of cores being operative to hold the conductors of the respective pair in coplanar relation to each other in a plane that is normal to the major planar extent of the ribbon cable.

16. A method of making a cable/connector assembly comprising the steps of:

molding a strain relief base onto a cable having a planar extent and including a plurality of generally parallel conductors and insulation therefor, the base having formed therein a plurality of externally opening recesses aligned with respective conductors of the cable;

connecting contacts to the cable, the contacts each having a terminal portion and a contacting portion, said connecting step including the step of inserting into the recesses the terminal portions of respective contacts to make electrical connection with the respective conductors interiorly of the base with the contacting portions of the contacts located externally of the base;

attaching to the molded base another member operative on at least part of the contacts to hold the contacts to the base; and rotating portions of plural pairs of relatively adjacent contacts to a generally right angle relationship with respect to the planar extent of the cable, the base thereafter being molded onto such portions of the conductors with the recesses corresponding to the conductors of each pair respectively being formed to open to different opposite sides of the base.

17. A method as set forth in claim 16, wherein the rotating step creates an area of twist in the conductors, and said molding step comprises molding the strain relief base such that the area of twist in the conductors is outside the base.

18. A method as set forth in claim 16, wherein the rotating step creates an area of twist in the conductors, and said molding step comprises molding the strain relief base such that the area of twist in the conductors is substantially entirely inside the base.

19. An electrical cable/connector assembly comprising:

a cable including at least one electrical conductor and insulation therefor;

a strain relief base molded onto said cable, said base including at least one recess means aligned with said conductor of said cable;

at least one contact means for effecting electrical connection between said electrical conductor and an external conductive member, said contact means including terminal means adapted for insertion into said recess means for effecting electrical connection to the respective conductor interiorly of said body and connecting means for electrically connecting with the external conductive member;

cover means positioned with respect to said base and at least part of said contact means for guiding the external member to engagement with said connecting means; and second strain relief means molded directly to at least part of said base, at least part of said contact means and at least part of said cover means to form an integral structure therewith.

20. The assembly of claim 19, comprising a plurality of said conductors in generally parallel relationship, a plurality of said contact means each including an electrical contact having a terminal portion and a connecting portion, and a plurality of said recess means to receive therein the terminal portion of respective ones of said electrical contacts for electrically connecting with respective ones of the conductors.

21. The assembly of claim 20, wherein the terminal portions of said contacts electrically connect with respective ones of said conductors by means of insulation displacement connections, and said second strain relief operates to maintain the insulation displacement connections.

22. The assembly of claim 20, wherein said second strain relief means is molded over said base to cover said plurality of recess means.

23. The assembly of claim 20, wherein said cover has along an edge thereof adjacent the base a locking recess into which a portion of said second strain relief means is molded.

24. A cable termination assembly comprising:

a generally flat electrical insulation, said cable having a longitudinal extent and a planar extent, at least one pair of said conductors having connecting portions rotated relative to each other about an axis generally parallel to the longitudinal extent of the cable and aligned with respect to one another in a direction generally perpendicular to the planar extent of the cable, said conductors of said pair having an area of rotation where said conductors are so rotated;

at least two electrical contacts each having terminal means for connecting with the connecting portion of a respective one of said pair of conductors and connecting means for connecting with an external electrically conductive member and;

a strain relief body molded directly to said cable including the area of rotation of said pair of conductors.

25. The assembly of claim 24, wherein said terminal means includes insulation displacement connection means for connecting with the connecting portion of the respective conductor.

26. The assembly of claim 25, wherein said strain relief body includes opening means for inserted passage of said insulation displacement connection means to engagement with the respective conductor to effect an insulation displacement connection.

27. The assembly of claim 25, further comprising cover means positioned with respect to said strain relief body and operative on at least a part of the contacts for holding the contact with respect to said strain relief body and in insulation displacement connection relation to respective conductors.

28. The assembly of claim 27, wherein said strain relief body includes opening means for inserted passage of said insulation displacement connection means to engagement with the respective conductor to effect an insulation displacement connection.

29. The assembly of claim 27, comprising strain relief means molded directly to at least part of said strain relief body, at least part of said contacts and at least part of said cover means for holding the same as an integral structure with said contacts in insulation displacement connection relation to respective cable conductors.

30. The assembly of claim 24, comprising plural rows of plural said contacts, and wherein the assembly has an outside dimensional profile, and the distance between such outside dimensional profile and the connecting means of the contacts in the rows thereof most proximate the outside dimensional profile of the assembly at the sides and ends thereof being about the same to provide for side and end stacking of the assembly with respect to other such assemblies on a pin field or the like.

31. The assembly of claim 30, wherein the contacts in one of said rows are at a different axial position in the assembly relative to the contacts in the other of said rows.

32. An electrical cable/connector assembly comprising:

a plurality of pairs of generally parallel electrical conductors and insulation therefor, the pairs of conductors being arranged in a row in generally coplanar relationship defining a plane of the conductor pairs, and the conductors of each pair having generally parallel connecting portions spaced apart at about the same spacing as the conductors of said pair in said plane, the connecting portions being disposed in a plane which is generally perpendicular to the plane of the conductor pairs and which intersects the plane of the conductor pairs along a line parallel to the connecting portions;

a strain relief base molded onto the cable and at least the connecting portions of the conductors, the base including recesses aligned with the connecting portions of respective ones of the conductors and opening to a respective side of the base; and a plurality of contact means for effecting electrical connections between respective ones of the conductors and external conductive members, said contact means including terminal means inserted into a respective one of the recesses for effecting electrical connection to the connecting portion of the respective conductor interiorly of the base and connecting means for electrically connecting with the respective external conductive member.

33. The assembly of claim 32, wherein the insulation includes insulation means holding the connecting portions of the conductors of each pair together in addition to electrically insulating the connecting portions.

34. The assembly of claim 32, wherein the insulation holds outside portions of the conductors outside the base in coplanar parallel relationship.

35. The assembly of claim 32, comprising a cover attached to the base, said cover including means operative on at least a part of each of the contact means for holding the contact means to the base.

36. The assembly of claim 35, wherein the connecting means and terminal means of each contact means extend generally perpendicularly with respect to one another.

37. The assembly of claim 32, wherein the connecting means of the plurality of contact means have a uniform center-to-center spacing, and the assembly is end stackable with another like assembly on a pin field having a center-to-center spacing equal the center-to-center spacing of the connecting means of the contacts.

38. The assembly of claim 37, wherein the base has end portions outboard of the insulation means for the laterally outermost pairs of conductors.

39. An electrical cable/connector assembly comprising:

a plurality of pairs of generally parallel electrical conductors and insulation therefor, the pairs of conductors being arranged in a row in generally coplanar relationship defining a plane of the conductor pairs, and the conductors of each pair having generally parallel connecting portions aligned with respect to one another in a direction generally perpendicular to the plane of the conductor pairs;

a strain relief base molded onto the cable and at least the connecting portions of the conductors, the base including recesses aligned with the connecting portions of respective ones of the conductors and opening to a respective side of the base; and a plurality of contact means for effecting electrical connections between respective ones of the conductors and external conductive members, said contact means including terminal means inserted into a respective one of the recesses for effecting electrical connection to the connecting portion of the respective conductor interiorly of the base and connecting means for electrically connecting with the respective external conductive member; and wherein the insulation includes insulation means holding the connecting portions of the conductors of each pair together in addition to electrically insulating the connecting portions, the insulation means for each pair of conductors is laterally spaced apart from the insulation means of the next adjacent pair of conductors to define spaces therebetween, and the base has side portions at opposite sides of the plane of the conductor pairs and other portions thereof molded into the spaces between the relatively spaced apart insulation means to provide for secure joinder of the side portions of the base.

40. The assembly of claim 39, wherein the base has end portions outboard of the insulation means for the laterally outermost pairs of conductors.

41. The assembly of claim 40, wherein the connecting means of the plurality of contact means have a uniform center-to-center spacing, and the assembly is end stackable with another like assembly on a pin field having a center-to-center spacing equal to center-to-center spacing of the connecting means of the contacts.

42. An electrical cable/connector assembly comprising:

a plurality of pairs of generally parallel electrical conductors and insulation therefor, the pairs of conductors being arranged in a row in generally coplanar relationship defining a plane of the conductor pairs, and the conductors of each pair having generally parallel connecting portions aligned with respect to one another in a direction generally perpendicular to the plane of the conductor pairs;

a strain relief base molded onto the cable and at least the connecting portions of the conductors, the base including recesses aligned with the connecting portions of respective ones of the conductors and opening to a respective side of the base; and a plurality of contact means for effecting electrical connections between respective ones of the conductors and external conductive members, said contact means including terminal means inserted into a respective one of the recesses for effecting electrical connection to the connecting portion of the respective conductor interiorly of the base and connecting means for electrically connecting with the respective external conductive member; and wherein the insulation holds outside portions of the conductors outside the base in coplanar parallel relationship and the conductors of each pair have a twisted portion intermediate the connecting and outside portions thereof.

43. The assembly of claim 42, wherein the base is molded around the twisted portion of the conductors of at least one of the pairs of conductors.

44. The assembly of claim 42, wherein the twisted portion of the conductors of at least one pair of conductors is substantially outside the base.

45. An electrical cable/connector assembly comprising:

a plurality of pairs of generally parallel electrical conductors and insulation therefor, said pairs of conductors being arranged in a row in generally coplanar relationship defining a plane of the conductor pairs, and the conductors of each pair having generally parallel connecting portions spaced apart at about the same spacing as the conductors of said pair in said plane, the connecting portions being disposed in a plane which is generally perpendicular to the plane of the conductor pairs and which intersects the plane of the conductor pairs along a line parallel to the connecting portions;

a strain relief base molded onto the cable and at least the connecting portions of the conductors, the base including recesses aligned with the connecting portions of respective ones of the conductors and opening to a respective side of the base;

a plurality of contact means for effecting electrical connections between respective ones of the conductors and external conductive members, said contact means including terminal means inserted into a respective one of the recesses for effecting insulation displacement connection to the connecting portion of the respective conductor interiorly of the base and connecting means for electrically connecting with the respective external conductive member; and cover means for surrounding the connecting means of the plurality of contact means and for providing guidance of the external conductive members to engagement with the connecting means of the plurality of contact means.

46. An electrical cable/connector assembly comprising:

a plurality of pairs of generally parallel electrical conductors and insulation therefor, the pairs of conductors being arranged in a row in generally coplanar relationship defining a plane of the conductor pairs, and the conductors of each pair having generally parallel connecting portions aligned with respect to one another in a direction generally perpendicular to the plane of the conductor pairs;

a strain relief base molded onto the cable and at least the connecting portions of the conductors, the base including recesses aligned with the connecting portions of respective ones of the conductors and opening to a respective side of the base; and a plurality of contact means for effecting electrical connections between respective ones of the conductors and external conductive members, said contact means including terminal means inserted into a respective one of the recesses for effecting electrical connection to the connection portion of the respective conductor interiorly of the base and connecting means for electrically connecting with the respective external conductive member; and wherein the connecting means of the plurality of contact means have a uniform center-to-center spacing, the assembly is end stackable with another like assembly on a pin field having a center-to-center spacing equal the center-to-center spacing of the connecting means of the contacts, the base has end portions outboard of the insulation means for the laterally outermost pairs of conductors, the insulation means for each pair of conductors is laterally spaced apart from the insulation means of the next adjacent pair of conductors to define spaces therebetween, and the base has side portions at opposite sides of the plane of the conductor pairs and other portions thereof molded into the spaces between the relatively spaced apart insulation means to provide for secure joinder of the side portions of the base.

* * * * *